US005101784A

United States Patent [19]

Tamaki

[11] Patent Number: 5,101,784

[45] Date of Patent: Apr. 7, 1992

[54] THROTTLE VALVE

[75] Inventor: Shigeo Tamaki, Katsuta, Japan

[73] Assignee: Hitachi, Ltd., Tokyo, Japan

[21] Appl. No.: 696,761

[22] Filed: May 7, 1991

[30] Foreign Application Priority Data

May 11, 1990 [JP] Japan ..... 2-119849

[51] Int. Cl.[5] ..... F02D 9/08

[52] U.S. Cl. ..... 123/337

[58] Field of Search ..... 123/337, 401, 400; 251/305, 306, 357, 358

[56] References Cited

U.S. PATENT DOCUMENTS

| | | | |
|---|---|---|---|
| 2,916,116 | 12/1959 | Eddy et al. | 123/337 |
| 3,675,731 | 7/1972 | Stopera | 123/337 |
| 4,002,085 | 1/1977 | Johnston | 123/337 |
| 4,474,150 | 10/1984 | Foley et al. | 123/401 |
| 4,491,106 | 1/1985 | Morris | 123/337 |
| 4,668,440 | 5/1987 | Sawner | 123/337 |
| 4,688,533 | 8/1987 | Otobe | 123/337 |
| 4,759,326 | 7/1988 | Uthoff, Jr. et al. | 123/337 |
| 4,905,647 | 3/1990 | Kizer et al. | 123/337 |
| 5,016,586 | 5/1991 | Imamura et al. | 123/337 |
| 5,035,218 | 7/1991 | Daly et al. | 123/337 |

*Primary Examiner*—Raymond A. Nelli

[57] ABSTRACT

An engine throttle valve with a driving motor for driving the throttle valve, comprises controller means for controlling the driving motor on the basis of an operation of an accelerator pedal so that a throttle movement of the throttle valve is controlled through the driving motor by the controller means on the basis of the operation of the accelerator pedal, wherein the throttle valve further comprises, first moving means which move in accordance with the throttle movement of the throttle valve, and second moving means which move in accordance with the operation of the accelerator pedal and are capable of engaging with the first moving means to move the first moving means, and the control means control a movement of the first moving means through the driving motor to prevent the first moving means from engaging with the second moving means when the accelerator pedal is pressed to open the throttle valve.

7 Claims, 1 Drawing Sheet

THROTTLE VALVE

BACKGROUND OF THE INVENTION AND RELATED ART STATEMENT

The present invention relates to a throttle valve with a throttle valve driving motor.

Publication of Laid-open Japanese Patent Application Sho63-277826 discloses that driving means, for example, a motor and the like controls the throttle opening degree without a mechanical petal mechanism. In this conventional device for controlling the throttle opening degree, a mechanism for returning compulsorily the throttle valve in a closing direction by a lever moved by the pedal operation when the driving motor is abnormal is employed. However, in the above conventional device, when the driving motor is out of order and the throttle valve is returned compulsorily in the closing direction during running on a highway or an ordinary road, an engine output decreases rapidly or the engine stops sometimes so that the driver feels uneasy.

OBJECT AND SUMMARY OF THE INVENTION

The object of the invention is to provide a throttle valve with a throttle valve driving motor, in which valve the throttle valve can be controlled when the throttle valve driving motor is out of order.

According to the present invention, a throttle valve with a driving motor for driving the throttle valve, comprises controller means for controlling the driving motor on the basis of an operation of an accelerator pedal so that a throttle movement of the throttle valve is controlled through the driving motor by the controller means on the basis of the operation of the accelerator pedal, wherein the throttle valve further comprises, first moving means which move in accordance with the throttle movement of the throttle valve, and second moving means which move in accordance with the operation of the accelerator pedal and are capable of engaging with the first moving means to move the first moving means, and the controller means control a movement of the first moving means through the driving motor to prevent the first moving means from engaging with the second moving means.

Since the throttle valve with the driving motor comprises first moving means which move in accordance with the throttle movement of the throttle valve, and second moving means which move in accordance with the operation of the accelerator pedal and are capable of engaging with the first moving means to move the first moving means, and the controller means controls a movement of the first moving means through the driving motor to prevent the first moving mean from engaging with the second moving means, the second moving means engage with the first moving means to move the first moving means when at least one of the controller means and the driving motor is out of order. Therefore, the throttle valve can be controlled through the second moving means by the accelerator pedal when the throttle valve driving motor is out of order.

DETAILED DESCRIPTION OF PREFERRED EMBODIMENTS

Figure 1:
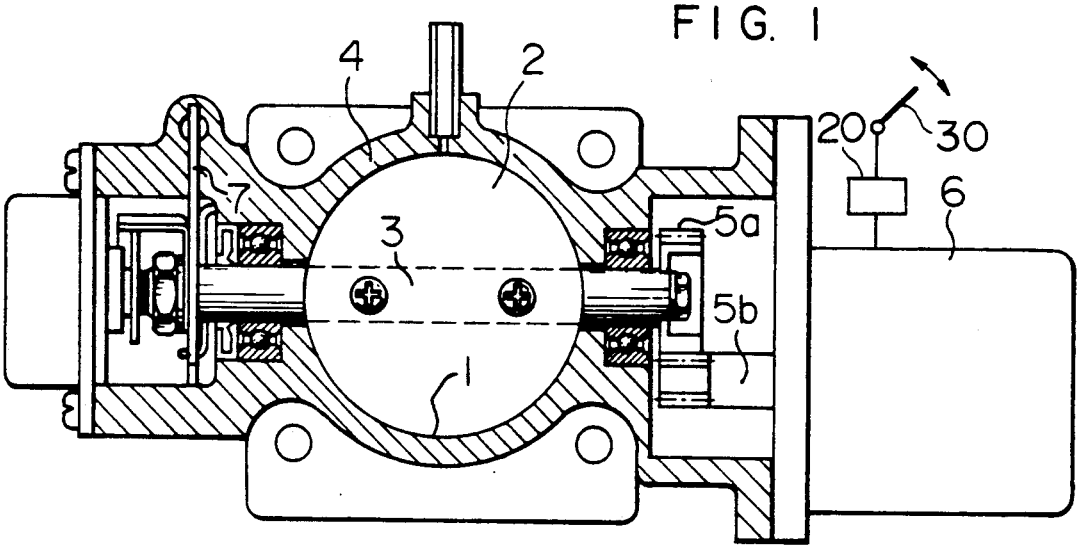
FIG. 1 is a cross-sectional view showing a throttle valve according to the present invention.

In FIGS. 1 to 4, a cross-sectional view and side views of the throttle valve are shown as an embodiment of the present invention. In these drawings, an intake air path formed with a cylindrical shape at a central portion of a throttle body 4 receives a throttle valve vane 2, and the throttle valve vane 2 is supported by a throttle valve shaft 3. The throttle valve shaft 3 extends through the throttle body 4 and both ends thereof are supported by ball-bearings 31 and 31 mounted on the throttle body 4 so that the throttle valve shaft 3 can rotate. A first gear 5*a* is fixed to one end of the throttle valve shaft 3 (a right end in the drawing) and engages with a second gear 5*b* fixed to an output shaft of a reversible driving motor 6. The driving motor 6 is controlled by a control device 20 in consideration of an engine condition and an automobile running condition on a pressed amount of an accelerator pedal, so that an opening degree of the throttle valve 2 is controlled as desired by a driver. The pressed amount of the accelerator pedal is measured and transmitted to the control device by an angle sensor.

A first lever 7 is fixed to another one end of the throttle valve shaft 3. A support shaft 8 is mounted on a part of the throttle body 1, and a second lever 9 is mounted on the support shaft 8 in a rotatable manner. The second lever 9 is rotated thereon by the accelerator pedal through a ball-joint 9*a* fixed on the second lever 9 and through a link connecting the second lever 9 to the accelerator pedal so that the second lever 9 is moved in accordance with a movement of the accelerator pedal. A coil-shaped return spring 10 as an elastic member is mounted on the support shaft 8 and engages with the second lever 9 so that the second lever 9 is urged to rotate the throttle valve vane 2 in a closing valve direction. A torque applied to the second lever 9 by the return spring is larger than the maximum rotational torque applied to the second lever 9 by the driving motor. A long hole 90 is formed on an upper forward end of the second lever 9, and a limit pin 7*a* formed by projecting from a plane surface of the first lever 7 is fitted in the long hole 90 in a slidable manner.

Figure 2:
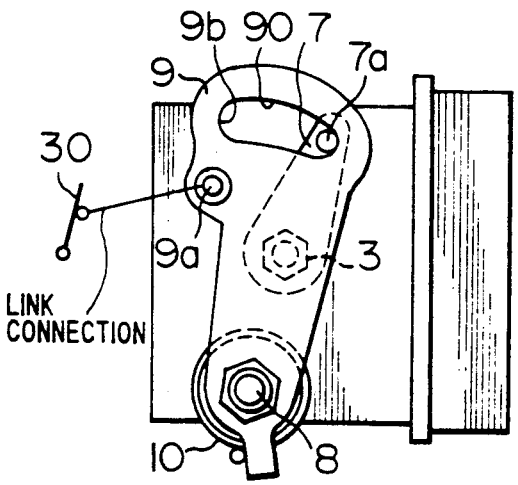
FIG. 2 is a side view of the throttle valve of FIG. 1 during an idle operation.

When the accelerator pedal is returned to or kept at an end position thereof for an idle operation of the engine and the second lever 9 moving in accordance with the accelerator pedal is kept at an end position thereof, as shown in FIG. 2, an end 9*c* of the long hole 90 contacts with the limit pin 7*a* to press the first lever 7 against an end position thereof so that the throttle valve vane 2 is kept at an idle position thereof regardless of an operation of the driving motor 6.

Figure 3:
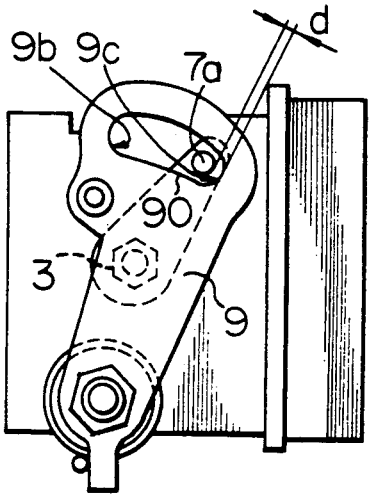
FIG. 3 is a side view of the throttle valve of FIG. 1 in which the accelerator pedal is pressed.
Figure 4:
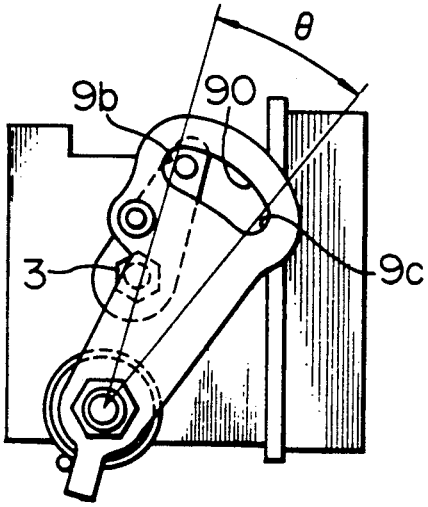
FIG. 4 is a side view of the throttle valve of FIG. 1 in which the accelerator pedal is pressed.

When the accelerator pedal 30 starts to be pressed forward from the end position thereof and the second lever 9 is rotated according to a pressed amount of the accelerator pedal, as shown in FIG. 3, a movement of the first lever 7 is started through the driving motor 6 by the control device 20 with a delay from the start of the start movement of the accelerator pedal 30 or with a start moving speed of the limit pin 7*a* of the first lever 7 smaller than that of the long hole 90 of the second lever 9 to form a clearance d between an end 9c of the long hole 90 and the limit pin 7a.

When the movement of the accelerator pedal 30 proceeds from the start thereof, the control device 20 controls the driving motor 6 not to make the clearance d less than a predetermined degree, that is, a speed and position of the limit pin 7a of the first lever 7 in the long hole 90 of the second lever 9 moving in accordance with the accelerator pedal 30 is adjusted through the driving motor 6 by the control device 20 on the basis of a speed and position of the accelerator pedal 30 so that the end 9c of the long hole 90 does not contact with the limit pin 7a during a normal operation of the throttle valve.

The long hole 90 has a length or an angle $\theta$ for accepting a free movement of the limit pin 7a therein. An acceptable range of the free movement of the limit pin 7a in the long hole 90 at each of the pressed degree of the accelerator pedal 30, that is, an acceptable range of the movement of the first lever 7 or the rotational degrees of the driving motor 6 in relation to the pressed degree of the accelerator pedal 30 is stored in the control device 20 to determine the opening degree of the throttle valve vane 2 therein. The acceptable range is determined on the basis of the length of the long hole 90, a diameter of the limit pin 7a, the desired minimum clearance between the limit pin 7a and both of the ends of the long hole 90 and the end positions of the levers 7 and 9. In consideration of the stored acceptable range of the free movement of the limit pin 7a in the long hole 90 in relation to the pressed degree of the accelerator pedal 30, the control device 6 can determine a desired opening degree of the throttle valve vane 2 corresponding to the driver's will on the basis of the pressed degree of the accelerator pedal 30, an automobile speed, an intake air pressure and so forth. The control device 20 calculates a difference between a measured actual opening degree of the throttle valve vane 2 and the determined desired opening degree and controls the driving motor 6 on the basis of the calculated difference so that the opening degree of the throttle valve vane 2 is kept at the desired degree.

In case the control device is out of order during operation so that the throttle valve vane 2 is urged in the opening direction or the closing direction by the driving motor 6 or in case the driving motor 6 can not be controlled with a wire cut-off, the end 9b and the end 9c of the long hole 90 of the second lever 9 press the limit pin 7a of the first lever 7 to rotate so that the second lever 9 urges the throttle valve 2 in the closing and opening directions with a torque of the return spring 10 larger than the torque of the driving motor 6 so that the throttle valve 2 is kept at a desird range corresponding to the pressed amount of the pedal. Therefore, the opening degree of the throttle valve 2 is kept at a range corresponding to the pressed amount of the pedal, that is, the driver's will even when the control device or the like is out of order.

In order to keep a controllable range of the first lever 7 or the throttle valve vane 2 in the above these emergency cases wide, it is preferable to make the length or angle $\theta$ as small as possible in consideration of an adjusting range of the opening degree of the throttle valve vane 2 needed for keeping an engine contition appropriate according to the pressed degree of the accelerator pedal 30. That is, it is preferable for the length or angle $\theta$ of the long hole 90 to be substantially equal to the minimum length or angle $\theta$ requisite for keeping the engine contition appropriate by calculating and adjusting the opening degree of the throttle valve vane 2 on the basis of measured various conditions of the engine and the pressed degree of the accelerator pedal 30.

Generally, when the driving motor 6 is stopped by a torque larger than a torque generated by the driving motor 6, the torque of the motor cannot be kept and a rapid closing action of the throttle valve vane 2, so-called loss of synchronism occurs. At this time, when the throttle valve vane 2 shuts down rapidly, the output power of the engine decreases rapidly and the driver feels uneasy. Therefore, in order to prevent the driver's uneasy feeling, the opening and closing of the throttle valve vane 2 is controlled through the limit pin 7a between the ends 9b, 9c at both sides of the long hole 90 of the second lever 7 so that the throttle valve vane 2 can be opened and closed for obtaining an certain engine output.

If the energizing wire of the driving motor is cut off, as described above, both of the sides of the long hole 90 of the second lever 7 controls the opening and closing operation of the throttle valve 2 so that the automobile can run according to the driver's will within a movable range of the throttle valve 2. In these emergency times, it is necessary for a movement in the long hole 90 to be smooth for smooth movements of the first lever 7 and the second lever 9. Therefore, more smooth movements can be achieved by using, for example, a low-slide-resistance roller in place of a bar as a shape of the limit pin 7a of the lever 7.

Figure 5:
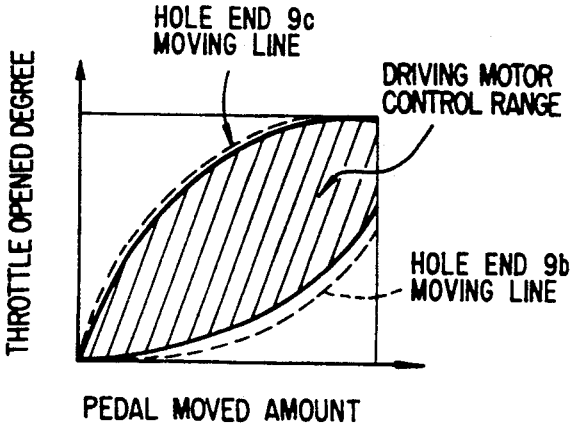
FIG. 5 is a diagram showing a relation between a throttle valve opening degree and an accelerator pedal pressed amount in the throttle valve according to the presenet invention.

FIG. 5 shows a driving motor operating range and an accelerator drum (the second lever) moving range (the throttle opening degree) in relation to the pressing amount of the accelerator pedal. Since the driving motor can be moved freely according to the automobile condition differently from the pedal operation by the control unit, the throttle opening degree can be increased by the driver's pedal operation when the output is needed or can be decreased when a decrease of the output is required. The most wide length of "the driving motor control range" in a direction parallel to a coordinate axis of "throttle opened degree" is equal to the maximum value of the above mentioned acceptable range.

When the accelerator pedal 30 starts to be moved backward toward the above mentioned end position thereof and the second lever 9 is rotated backward according to a pressed amount of the accelerator pedal 30, a backward movement of the first lever 7 is started through the driving motor 6 by the control device 20 simultaneously with the start of the backward movement of the accelerator pedal 30 to keep the clearance d between the end 9c of the long hole 90 and the limit pin 7a. When the backward movement of the accelerator pedal 30 proceeds from the start thereof, the control device 20 controls the driving motor 6 not to make the clearance d less than a predetermined degree, that is, the speed and position of the limit pin 7a in the long hole 90 of the second lever 9 moving in accordance with the accelerator pedal 30 is adjusted through the driving motor 6 by the control device 20 on the basis of the speed and position of the accelerator pedal 30 so that the end 9c of the long hole 90 does not contact with the limit pin 7a during the normal operation of the throttle valve. The first lever 7 reaches the above mentioned end, that is, a start point thereof before or when the second lever 9 reaches the above mentioned end, that is, a start point thereof.

What is claimed is:

1. An engine throttle valve with a driving motor for driving the throttle valve, comprising controller means for controlling the driving motor on the basis of an operation of an accelerator pedal so that a throttle movement of the throttle valve is controlled through the driving motor by the controller means on the basis of the operation of the accelerator pedal, wherein the throttle valve further comprises, first moving means which move in accordance with the throttle movement of the throttle valve, and second moving means which move in accordance with the operation of the accelerator pedal and are capable of engaging with the first moving means to move the first moving means, and the control means control a movement of the first moving means through the driving motor to prevent the first moving means from engaging with the second moving means when the accelerator pedal is pressed to open the throttle valve.

2. An engine throttle valve according to claim 1, wherein the second moving means moving in accordance with the accelerator pedal contacts with the first moving means to press the first moving means against an idle operation end point when the accelerator pedal is kept at an end position thereof for an idle operation of the engine so that the throttle valve is kept at an idle position thereof regardless of a operation of the driving motor.

3. An engine throttle valve according to claim 1, wherein a movement of the first moving means is started through the driving motor by the control means with a start moving speed of the first moving means from an end position thereof for an idle operation of the engine smaller than that of the second moving means to form a clearance between the first moving means and the second moving means when the accelerator pedal starts to be pressed forward from the end position thereof for the idle operation of the engine and the second moving means is moved according to a pressed amount of the accelerator pedal.

4. An engine throttle valve according to claim 1, wherein a movement of the first moving means is started through the driving motor by the control means with a time delay from a start of a movement of the accelerator pedal from an end position thereof for an idle operation of the engine to form a clearance between the first moving means and the second moving means when the accelerator pedal starts to be pressed forward from the end position thereof for the idle operation of the engine and the second moving means is moved according to a pressed amount of the accelerator pedal.

5. An engine throttle valve according to any one of claims 3 and 4, wherein a speed and position of the first moving means is adjusted through the driving motor by the control means on the basis of a position and pressed speed of the accelerator pedal so that the clearance between the first moving means and the second moving means is kept more than a predetermined degree when the movement of the accelerator pedal proceeds from the start thereof.

6. An engine throttle valve according to claim 1, wherein the second moving means is urged by a spring toward an end position thereof for an idle operation of the engine, and a force moving the second moving means by the spring is larger than a force moving the second moving means through the first moving means by the driving motor so that the second moving means returns automatically to the end position thereof for the idle operation of the engine when the accelerator pedal is not pressed.

7. An engine throttle valve according to any one of claims 3 and 4, wherein a backward movement of the first moving means is started through the driving motor by the control means simultaneously with a start of a backward movement of the accelerator pedal to keep the clearance between the first moving means and the second moving means when the accelerator pedal starts to be moved backward toward the end position thereof for the idle operation of the engine and the second moving means is moved backward according to the accelerator pedal.

* * * * *

UNITED STATES PATENT AND TRADEMARK OFFICE

CERTIFICATE OF CORRECTION

PATENT NO. : 5,101,784
DATED : April 7, 1992
INVENTOR(S) : Tamaki

It is certified that error appears in the above-indentified patent and that said Letters Patent is hereby corrected as shown below:

On the Title page, item [73], Assignee: should read--Hitachi, Ltd, Tokyo, Japan, and Hitachi Automotive Engineering Co., Ltd., Ibaraki-Ken, Japan--.

Signed and Sealed this

Eleventh Day of October, 1994

*Attest:*

Bruce Lehman

BRUCE LEHMAN

*Attesting Officer*

*Commissioner of Patents and Trademarks*